United States Patent [19]

Amboss

[11] Patent Number: 4,687,417

[45] Date of Patent: Aug. 18, 1987

[54] HIGH VOLTAGE FEEDTHROUGH FOR ION PUMP

[75] Inventor: Kurt Amboss, Pacific Palisades, Calif.

[73] Assignee: Hughes Aircraft Company, Los Angeles, Calif.

[21] Appl. No.: 810,486

[22] Filed: Dec. 19, 1985

[51] Int. Cl.[4] ..... F04B 37/02; F04F 11/00

[52] U.S. Cl. ..... 417/49; 313/560

[58] Field of Search ..... 417/48, 49, 51; 313/560

[56] References Cited

U.S. PATENT DOCUMENTS

| | | | |
|---|---|---|---|
| 3,018,944 | 1/1962 | Zaphiropoulos | 417/49 |
| 3,088,657 | 5/1963 | Zaphiropoulos | 417/49 |
| 3,174,069 | 3/1965 | Jepsen | 417/49 |
| 3,228,590 | 1/1966 | Kearns | 417/49 |
| 3,231,175 | 1/1966 | Zaphiropoulos. | |
| 3,381,890 | 5/1968 | Hayashi | 417/49 |
| 3,460,745 | 8/1969 | Lamont, Jr. | |

*Primary Examiner*—Carlton R. Croyle
*Assistant Examiner*—Donald E. Stout
*Attorney, Agent, or Firm*—Paul M. Coble; A. W. Karambelas

[57] ABSTRACT

Ion pump (10) has feedthrough (33) for electrical connection to anode post (32) within the pumping chamber. Opening (36) in the pumping chamber wall receives a portion of insulator (42). The insulator (42) has a flange (48) which is of larger diameter than the opening (36) so that sputtered cathode material cannot directly disposit on the outer and upper surfaces of the flange (48).

8 Claims, 3 Drawing Figures

HIGH VOLTAGE FEEDTHROUGH FOR ION PUMP

BACKGROUND OF THE INVENTION

1. Field of the Invention

This invention is directed to a high voltage feedthrough particularly useful for ion pumps.

2. Description of Related Art

One class of vacuum pump is the ion pump. Both active and inert gases are pumped by precipitation or adsorption following molecular dissociation, gettering by freshly sputtered cathode material, surface burial under sputtered cathode material, ion burial following ionization in the discharge, and/or fast neutral atom burial. The ion pump is basically a low pressure cold cathode Penning discharge. In a Penning cell, the electric fields trap electrons in a potential well between two cathodes, and the axial magnetic field forces the electrons into circular orbits to prevent their reaching the anode. This combination of electric and magnetic fields causes the electrons to travel long distances in oscillating spiral paths before colliding with the anode. These long paths result in a high probability of ionizing collisions with gas molecules. An excellent description of the operation of ion pumps, with dimensions and operating parameters similar to those encountered in a 0.2 liter per second ion pump has been given by Wolfgang Knauer in "Mechanism of the Penning Discharge at Low Pressures," *Journal of Applied Physics,* Volume 33, Number 6, pages 2093 through 2099 (June, 1962).

As a result of this activity at the cathode, sputtering occurs. The sputtered material, having a neutral charge, travels in a straight line from the point of sputtering.

The high voltage feedthrough feeding the anode includes a ceramic insulator which is exposed to the interior of the pump. In the conventional pump, sputtered material deposits on the ceramic insulator. After a sufficient time has elapsed, a conducting layer of cathode metal builds up. This layer short-circuits the anode to the main body of the pump which is at cathode potential. Because sputtering is directly proportional to the anode current, the life of the pump is directly proportional to the total charge which has flowed through the anode circuit.

One solution to the problem has been to place a flat disc on the anode lead, inside the cathode, to shield the ceramic from sputtering. However, in view of the tubular nature of the vacuum housing, adequate shielding has not been possible because the curved surface of the vacuum housing comes too close to the flat shield disc when the disc is of adequate size to provide proper shielding. Therefore, there is need for a construction wherein sputtering is prevented from creating a short circuit path along the anode feedthrough insulator.

SUMMARY OF THE INVENTION

It is, thus, a purpose and advantage of this invention to provide a high voltage feedthrough for an ion pump which provides an extended life for the ion pump.

It is a further purpose and advantage of this invention to provide a feedthrough connector for supporting and applying an electrical potential to the anode of an ion pump in a manner preventing the creation of a short circuit path along the anode feedthrough insulator.

It is a still further purpose and advantage of this invention to provide an ion pump which may be employed in locations where maintenance is difficult and where long life is particularly required.

An ion pump according to the invention includes a pump vacuum body having a pumping chamber containing an anode and a cathode. A feedthrough arrangement including a tubular insulator extends into an opening in the vacuum body to afford electrical connection to the anode. The feedthrough insulator is configured to be out of the line-of-sight of ion pump sputtering so that it avoids sputter-generated deposition.

Other purposes and advantages of this invention will become apparent from a study of the following portion of the specification, the claims and the attached drawings.

DESCRIPTION OF THE PREFERRED EMBODIMENTS

Figure 1:
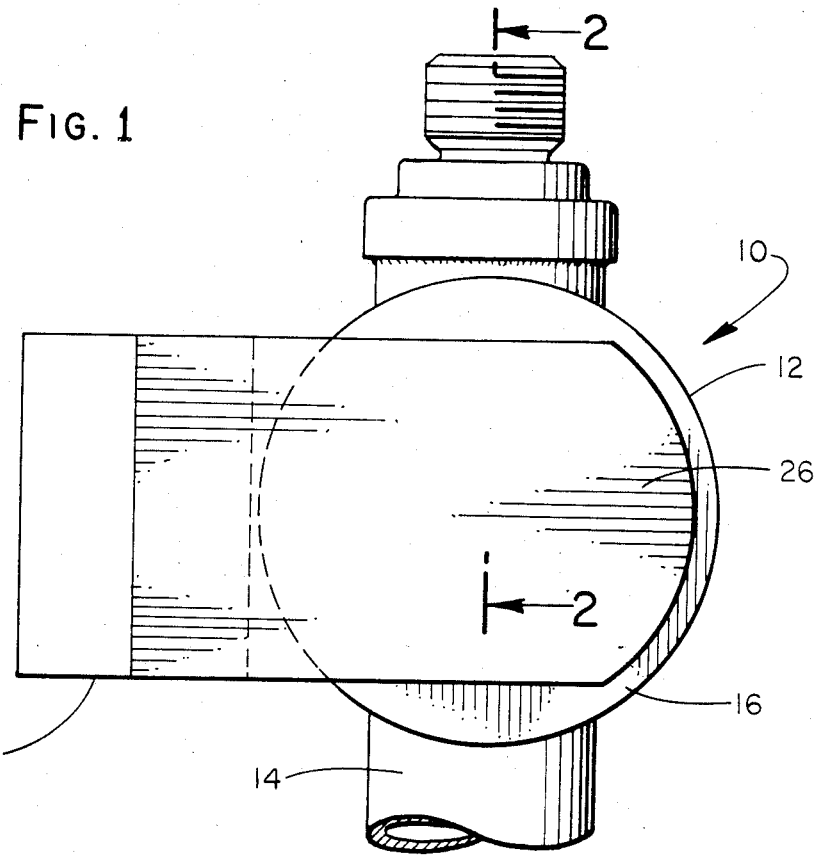
FIG. 1 is a side-elevational view of an ion pump which contains a first preferred embodiment of the high voltage feedthrough in accordance with this invention.
Figure 2:
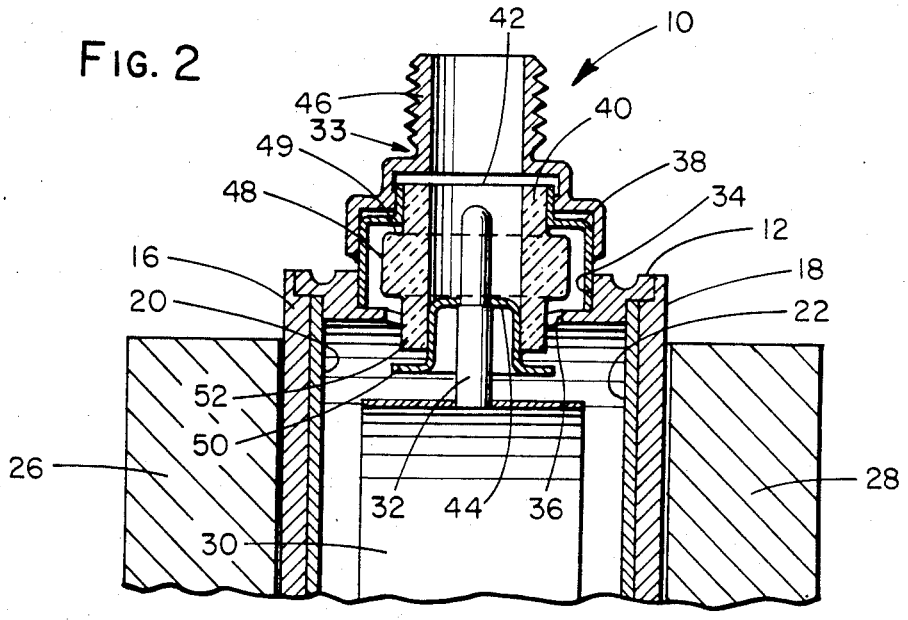
FIG. 2 is an enlarged sectional view, taken generally along the line 2—2 of FIG. 1.

An ion pump is generally indicated at 10 in FIG. 1. Ion pump 10 may be a 0.2 liter per second ion pump, which is a convenient and common size. When a higher pumping rate is desired, it is usual to connect a plurality of such ion pumps in parallel. Ion pump 10 has a cylindrical tubular vacuum body 12 which is at cathode potential. The body 12 has connected thereto a suction tube 14 which is connected to the vacuum space from which ion pump 10 is to pump gases. The cylindrical tubular nature of body 12 is seen in FIG. 2, where the ends of the body are closed by caps 16 and 18. Interiorly of and held by the caps 16 and 18 against shoulders in the body 12 are cathode discs 20 and 22. These discs are commonly of titanium. A U-shaped permanent magnet 24 has its pole faces 26 and 28 positioned outside of the caps 16 and 18 in order to provide a magnetic field in the left and right direction in FIG. 2 and normal to the sheet in FIG. 1. Alternatively, one or more individual magnets provided with suitable pole pieces could be used.

Anode 30 is a metallic right circular cylindrical tube of thin wall construction. It is mounted centrally of body 12 and equally spaced from cathode discs 20 and 22. It is held in this position by means of post 32 which is secured to anode 30 and extends radially outwardly therefrom into a feedthrough 33. Post 32 defines a feedthrough axis which is normal to the axis of the anode 30 and the pump vacuum body 12.

Recess 34 is formed in a portion of the outer surface of the pump body 12. Within recess 34 is opening 36 by which the recess 34 opens into the interior of the pump body 12. Cup 38 is mounted within recess 34. Cup 38 is basically a reducer, having a larger diameter portion within the recess 34 and a smaller diameter portion retaining an upper boss 40 of ceramic insulator 42. The insulator 42 has a cylindrical hole therethrough, and within the lower end of the hole there is mounted a cup 44. The cup 44 has a hole therein, and the post 32 extends through the hole in the cup 44. A shoulder on the post 32 positions the post 32 with respect to the cup 44. Cups 38 and 44 are metallic, as is post 32. The cups 38 and 44 are brazed to the ceramic insulator 42, and the outer cup 38 is braced to body 12. The inner cup 44 is brazed to the post 32. In that way, a vacuum seal with electrical insulation is provided.

In order to aid in making electrical connection, a fitting 46 is provided with an interior opening and external threads. The fitting 46 is brazed onto outer cup 38. With the opening in the fitting 46, the pin 32 is accessible. A conductor (not shown) may be secured onto the threads of the fitting 46 and has a socket adapted to receive post 32. The fitting 46 and the body 12 are at cathode potential, while the socket is at anode potential to provide the requisite voltage between the anode 30 and the cathode discs 20 and 22. Suitable dimensions are disclosed in the Wolfgang Knauer article, cited above, the entire disclosure of which is incorporated herein by this reference. The magnetic field is usually above 1200 Gauss, while the applied voltage may be about 3.5 kilovolts.

All of the parts of the feedthrough thus described are coaxial around the axis of post 32. In order to prevent a line of sight from the cathode discs 20 and 22 to the exterior surface of insulator 42, the exterior of the insulator 42 is provided with a radially outwardly projecting annular flange, or shoulder, 48 above the opening 36 in the body 12. The continuous upper surface 49 of the flange 48 extends all around the insulator 42 and is not visible through opening 36, and in addition, the flange 48 has a greater outer diameter than the opening 36 and, thus, the outer cylindrical surface of flange 48 is not visible through opening 36. In this way, sputtered metal from the titanium cathodes is prevented from line of sight deposition on the outside of the flange 48, the radial upper surface 49 on the top of the flange 48 and the cylindrical surface above the flange, as seen in FIG. 2. Thus, a large area is not subject to receipt of sputtered cathode metal and, as a consequence, is protected against short circuiting caused by such sputtered metal.

In addition, an outwardly directed flange 50 may be provided on the lower edge of cup 44 and below ceramic insulator 42. The flange 50 extends radially outwardly to a diameter larger than the smaller diameter of upper boss 40 of the insulator 42. This is helpful in reducing the line of sight deposition through the opening 36 around the lower boss 52 of the insulator. A very much improved life is achieved.

Figure 3:
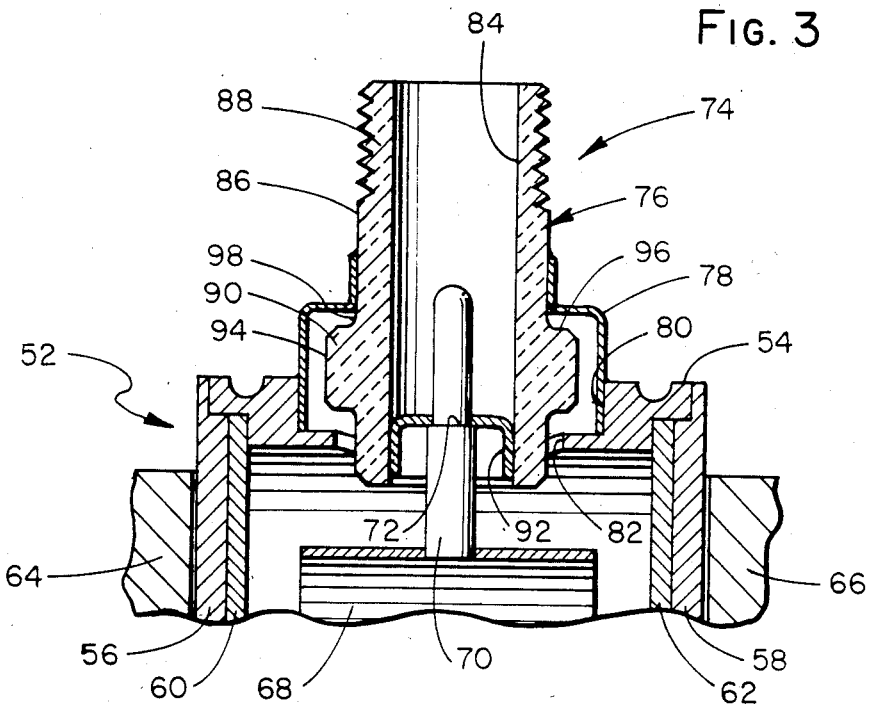
FIG. 3 is a further enlarged view, similar to FIG. 2, showing a second preferred embodiment of the high voltage feedthrough in accordance with this invention.

FIG. 3 shows in section, with parts broken away, a second preferred embodiment of the feedthrough of this invention, this time shown on ion pump 52. Ion pump 52 has the same body 54, caps 56 and 58, cathode discs 60 and 62, and pole pieces 64 and 66 of a permanent magnet, corresponding to the similar parts shown in FIGS. 1 and 2 with respect to ion pump 10. Similarly, anode 68 is coaxial with the body 54 and has a radially extending post 70. Post 70 has a shoulder 72 thereon, similarly to post 32. Post 70 is used to hold the anode 68 in position and to supply anode potential to it. Feedthrough 74 is of more simple construction and has fewer parts than the feedthrough 33 of FIG. 2 by employment of a ceramic insulator as the threaded end of the connection fitting.

Tubular ceramic insulator 76 is carried on hollow reducing bushing, or cup, 78 which is secured within recess 80 which is radially positioned in the wall of body 54. Opening 82 extends between recess 80 and the interior of the body 54. Ceramic insulator 76 has a cylindrical interior wall 84 of the same diameter throughout its entire length and a coaxial cylindrical exterior wall 86 which is interrupted by threads 88 and radially outwardly projecting annular flange 90. Flange 90 is of equal or preferably larger diameter than opening 82. Cup 78 engages upon the exterior wall 86 above flange 90 to secure the insulator 76 in place, with its axis coextensive with the axis of radial post 70. Cup 92 is secured against shoulder 72 and is secured against the interior wall 84 at its lower end, as shown in FIG. 3. All joints are brazed so that the exterior of the insulator 76 is sealed to the body 54 and the interior of the insulator 76 is sealed to the post 70. In this way, vacuum integrity through the feedthrough 74 is achieved.

Connection to the anode 68 can be made by placing a socket over the post 70. The socket can be held in place by means of engagement on the threads 88. In this case, a separate cathode connection must be made. However, the cathode potential is usually the potential of the equipment to which the ion pump is attached and, therefore, the cathode connection is easily made.

Since the diameter of annular flange 90 is greater than the opening 82, neither the outer surface 94 or the top surface 96 of the annular flange 90 can be seen through the opening 82. Neither can the portion 98 of the insulator 76 above flange 90 and below cup 78 be seen through opening 82. Each of these surfaces extends completely around the insulator 76. Therefore, when sputtering occurs on the titanium cathode surfaces and neutral metal particles are sputtered away, the particles cannot reach the outer surface 94 of annular flange 90 and the insulator surfaces 96 and 98 above it. Therefore, the insulator cannot be shortcircuited by the deposition of sputtered metal. In this way, a long ion pump life is achieved.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An ion pump comprising:

an ion pump body, said body having a pumping chamber therein, a vacuum connection to said pumping chamber so that said pumping chamber can be connected to a volume to be pumped, a cathode within said pumping chamber, a feedthrough opening in said body;

an anode within said pumping chamber, a post on said anode, said post extending through said feedthrough opening for support and electrical connection of said anode;

a tubular ceramic insulator bushing forming a feedthrough insulator, said bushing having an exterior wall and an interior wall, a portion of said exterior wall being sealed to said ion pump body and a portion of said interior wall being sealed to said post to provide vacuum integrity to said pumping chamber, said exterior wall of said ceramic bushing including a radially outwardly projecting annular flange extending radially exteriorly of said feedthrough opening in said body, the space radially exteriorly of said annular flange being exposed to the vacuum of said vacuum chamber, said annular flange having an exterior lateral surface extending completely around said insulator bushing and which is not visible through said feedthrough opening in said body so that said exterior surface extending completely around said insulator bushing is not in a direct sputtering line from said cathode.

2. The ion pump of claim 1 wherein said flange has a larger diameter than said feedthrough opening in said body so that the exterior surface of said radially outwardly projecting annular flange on said ceramic tubular insulator is not visible from said pumping chamber.

3. The ion pump of claim 2 wherein said tubular insulator bushing and said feedthrough opening in said body define figures of revolution around the axis of said post on said anode, and said post on said anode extends into the tubular interior of said ceramic insulator bushing.

4. The ion pump of claim 3 wherein said post is sealed to a cup, and said cup is sealed to the interior of said ceramic insulator bushing adjacent the pumping chamber end thereof.

5. The ion pump of claim 4 wherein said insulator bushing is sealed to said body by means of a cup which is sealed to said body radially outwardly from said flange and is sealed to the exterior surface of said insulator bushing beyond said flange with respect to said pumping chamber 6. A high voltage feedthrough comprising:

a chamber in which sputtering occurs and having an opening in a wall thereof;

a tubular insulator having a projecting portion thereof positioned on the side of said opening away from said sputtering chamber, which portion extends completely around said tubular insulator and is not visible from said sputtering chamber;

a first cup secured to the exterior of said tubular insulator beyond the side of said portion away from said opening and sealed to said wall to provide a vacuum seal around the exterior of said tubular insulator, a connector extending from said sputtering chamber into the interior of said tubular insulator for electrical connection to an electrical device within said sputtering chamber; and a second cup sealed to said connector and to said tubular insulator for providing a vacuum seal through the interior of said tubular insulator.

7. The high voltage feedthrough of claim 6 wherein said opening is a circular opening and said projecting portion is a radially outwardly projecting angular flange substantially coaxial with said circular opening so that the outer lateral surface of said flange is not visible through said circular opening.

8. The high voltage feedthrough of claim 7 wherein said chamber is the pumping chamber of an ion pump, and said feedthrough provides an anode connection for said ion pump.

* * * * *